US010830061B2

(12) United States Patent
Marsh et al.

(10) Patent No.: US 10,830,061 B2
(45) Date of Patent: Nov. 10, 2020

(54) TURBINE AIRFOIL WITH INTERNAL COOLING CHANNELS HAVING FLOW SPLITTER FEATURE

(71) Applicant: Siemens Aktiengesellschaft, Munich (DE)

(72) Inventors: Jan H. Marsh, Orlando, FL (US); Paul A. Sanders, Charlotte, NC (US); Evan C. Landrum, Charlotte, NC (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 111 days.

(21) Appl. No.: 16/089,598

(22) PCT Filed: Mar. 31, 2016

(86) PCT No.: PCT/US2016/025128
§ 371 (c)(1),
(2) Date: Sep. 28, 2018

(87) PCT Pub. No.: WO2017/171764
PCT Pub. Date: Oct. 5, 2017

(65) Prior Publication Data

US 2019/0101011 A1 Apr. 4, 2019

(51) Int. Cl.
*F01D 5/18* (2006.01)
*F01D 9/04* (2006.01)

(52) U.S. Cl.
CPC ..... *F01D 5/189* (2013.01); *F01D 5/186* (2013.01); *F01D 5/188* (2013.01); *F01D 9/041* (2013.01);
(Continued)

(58) Field of Classification Search
CPC ..... F01D 5/189; F01D 5/188; F01D 5/186; F01D 5/187; F01D 9/041; F05D 2240/127; F05D 2250/185
(Continued)

(56) References Cited

U.S. PATENT DOCUMENTS 5,361,828 A * 11/1994 Lee ..... F01D 5/187 165/109.1
5,738,493 A 4/1998 Lee et al.
(Continued)

FOREIGN PATENT DOCUMENTS

EP 0661414 A1 * 7/1995 ..... F28F 3/02
EP 0661414 A1 7/1995
(Continued)

OTHER PUBLICATIONS

PCT International Search Report and Written Opinion dated Dec. 22, 2016 corresponding to PCT Application No. PCT/US2016/025128 filed Mar. 31, 2016.

*Primary Examiner* — J. Todd Newton

(57) ABSTRACT

An airfoil (10) includes at least one internal cooling channel (A-F) extending in the radial direction and adjoined on opposite sides by an airfoil pressure sidewall (16) and an airfoil suction sidewall (18). An internal surface (16*a*) of the airfoil pressure sidewall (16) and an internal surface (18*a*) of the airfoil suction sidewall (18) define heat transfer surfaces in relation to a coolant flowing through the internal cooling channel (A-F). A flow splitter feature (90) is located in a flow path of the coolant in the internal cooling channel (A-F) between the pressure and suction sidewalls (16, 18). The flow splitter feature (90) is effective to create a flow separation region downstream of the flow splitter feature (90), whereby coolant flow velocity is locally increased along the internal surfaces (16*a*, 18*a*) of the pressure and suction sidewalls (16, 18).

17 Claims, 6 Drawing Sheets

(52) U.S. Cl.
CPC .... *F05D 2220/32* (2013.01); *F05D 2240/121* (2013.01); *F05D 2240/122* (2013.01); *F05D 2240/127* (2013.01); *F05D 2240/24* (2013.01); *F05D 2250/185* (2013.01); *F05D 2260/202* (2013.01); *F05D 2260/221* (2013.01); *F05D 2260/2212* (2013.01)

(58) Field of Classification Search
USPC ..... 416/97 R
See application file for complete search history.

(56) References Cited

U.S. PATENT DOCUMENTS

2007/0128034 A1* 6/2007 Lee ..... F01D 5/187 416/97 R
2011/0164960 A1* 7/2011 Maldonado ..... F01D 5/186 415/115
2014/0212297 A1* 7/2014 Goeller ..... F01D 5/187 416/96 A
2015/0139814 A1* 5/2015 Horiuchi ..... F01D 5/187 416/97 R
2015/0377029 A1* 12/2015 Blake ..... F01D 5/18 416/232
2016/0186660 A1* 6/2016 Bergholz ..... F01D 5/18 416/95
2017/0096900 A1* 4/2017 Bunker ..... F01D 5/145
2017/0107831 A1* 4/2017 Itzel ..... F01D 5/187
2018/0163545 A1* 6/2018 Bang ..... F01D 5/189
2018/0245472 A1* 8/2018 Spangler ..... F01D 9/065
2019/0024515 A1* 1/2019 Marsh ..... F01D 5/147
2019/0093487 A1* 3/2019 Marsh ..... F01D 5/186
2019/0101011 A1* 4/2019 Marsh ..... F01D 5/186

FOREIGN PATENT DOCUMENTS

WO 2015171145 A1 11/2015
WO WO-2015171145 A1 * 11/2015 ..... F01D 5/18

* cited by examiner

VIEW II-II

View III-III

View IV-IV

View V-V

View VI-VI

TURBINE AIRFOIL WITH INTERNAL COOLING CHANNELS HAVING FLOW SPLITTER FEATURE

BACKGROUND

1. Field

The present invention is directed generally to turbine airfoils, and more particularly to turbine airfoils having internal cooling channels for conducting a coolant through the airfoil.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power. Since the airfoils, i.e., vanes and turbine blades, are directly exposed to the hot combustion gases, they are typically provided with internal cooling channels that conduct a cooling fluid, such as compressor bleed air, through the airfoil.

One type of turbine airfoil includes a radially extending outer wall made up of opposite pressure and suction sidewalls extending from a leading edge to a trailing edge of the airfoil. The cooling channel extends inside the airfoil between the pressure and suction sidewalls and conducts the cooling fluid in alternating radial directions through the airfoil. The cooling channels remove heat from the pressure sidewall and the suction sidewall and thereby avoid overheating of these parts.

In a turbine airfoil, achieving a high cooling efficiency based on the rate of heat transfer is a significant design consideration in order to minimize the volume of coolant air diverted from the compressor for cooling.

SUMMARY

Briefly, aspects of the present invention provide a turbine airfoil with internal cooling channels having a flow splitter feature to enhance heat transfer at the pressure and suction sidewalls.

According to a first aspect of the present invention, a turbine airfoil is provided. The turbine airfoil comprises an outer wall delimiting an airfoil interior. The outer wall extends span-wise along a radial direction of a turbine engine is formed of a pressure sidewall and a suction sidewall joined at a leading edge and a trailing edge. The turbine airfoil includes at least one internal cooling channel in the airfoil interior. The internal cooling channel extends in the radial direction and is adjoined on opposite sides by the pressure sidewall and the suction sidewall such that an internal surface of the pressure sidewall and an internal surface of the suction sidewall define heat transfer surfaces in relation to a coolant flowing through the internal cooling channel. A flow splitter feature is located in a flow path of the coolant in the internal cooling channel between the pressure and suction sidewalls. The flow splitter feature is effective to create a flow separation region downstream of the flow splitter feature, whereby coolant flow velocity is locally increased along the internal surfaces of the pressure and suction sidewalls, to enhance heat transfer between the coolant and the outer wall.

According a second aspect of the present invention, a turbine airfoil is provided. The turbine airfoil includes an outer wall delimiting an airfoil interior. The outer wall extends span-wise along a radial direction of a turbine engine is being formed of a pressure sidewall and a suction sidewall joined at a leading edge and a trailing edge. At least one partition wall is positioned in the airfoil interior connecting the pressure and suction sidewalls along a radial extent so as define a plurality of radial cavities in the airfoil interior. An elongated flow blocking body positioned in at least one of the radial cavities so as to occupy an inactive volume therein. The flow blocking body extends in the radial direction is being spaced from the pressure sidewall, the suction sidewall and the partition wall, whereby: a first near-wall cooling channel is defined between the flow blocking body and the pressure sidewall, a second near-wall cooling channel is defined between the flow blocking body and the suction sidewall, and a connecting channel is defined between the flow blocking body and the partition wall. The connecting channel is connected to the first and second near-wall cooling channels along a radial extent to define a radially extending internal cooling channel. A flow splitter feature is located at an inlet of the internal cooling channel. The flow splitter feature is shaped to create a flow separation region downstream of the flow splitter feature in the connecting channel, whereby coolant flow velocity is locally increased in the first and second near-wall cooling channels in relation to the connecting channel, to enhance heat transfer between the coolant and the outer wall.

BRIEF DESCRIPTION OF THE DRAWINGS

The invention is shown in more detail by help of figures. The figures show preferred configurations and do not limit the scope of the invention.

DETAILED DESCRIPTION

Figure 1:
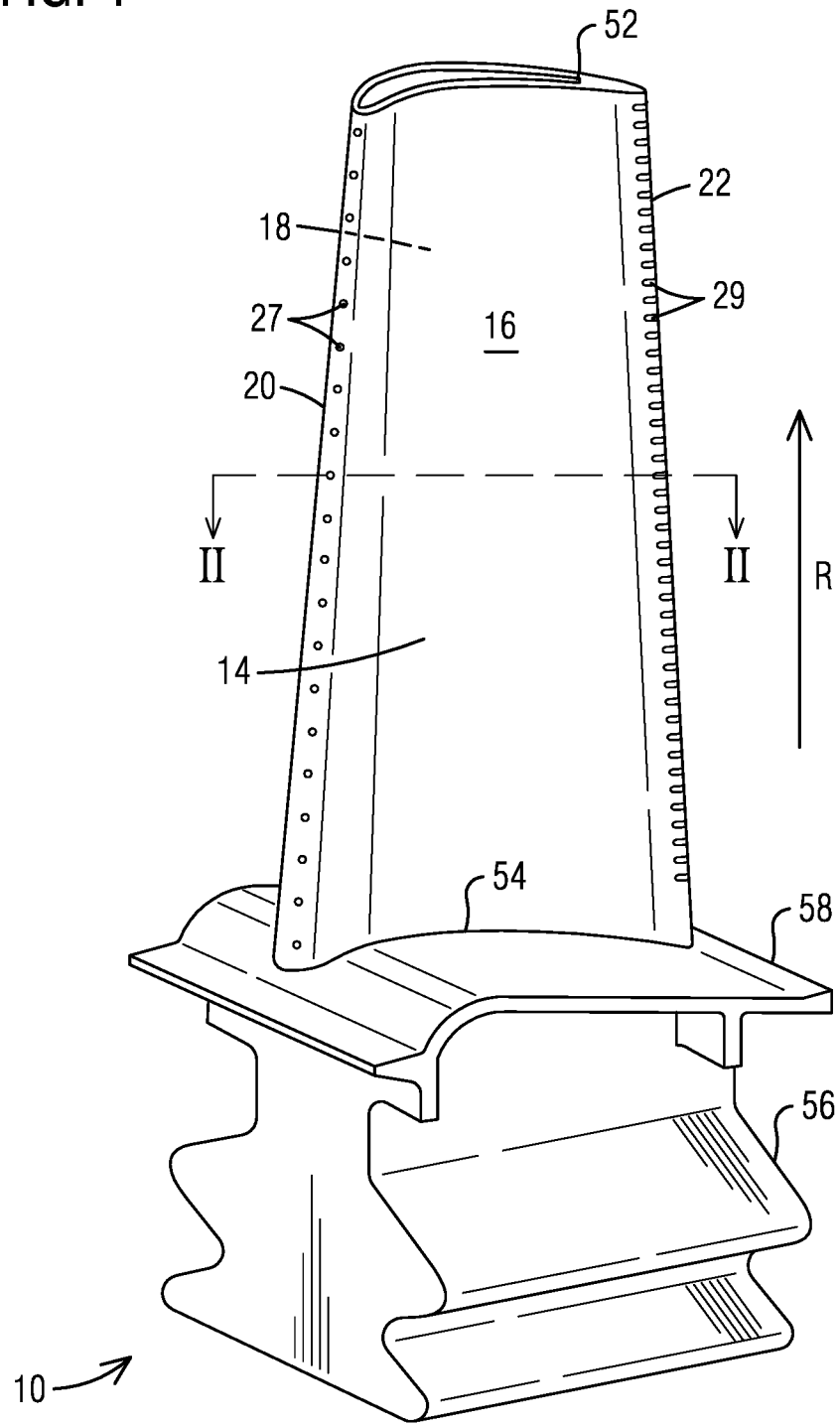
FIG. 1 is a perspective view of a turbine airfoil featuring embodiments of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Aspects of the present invention relate to an internally cooled turbine airfoil. In a gas turbine engine, coolant supplied to the internal cooling channels in a turbine airfoil often comprises air diverted from a compressor section. Achieving a high cooling efficiency based on the rate of heat transfer is a significant design consideration in order to minimize the volume of coolant air diverted from the compressor for cooling. Many turbine blades and vanes involve a two-wall structure including a pressure sidewall and a suction sidewall joined at a leading edge and at a trailing edge. Internal cooling channels are created by employing internal partition walls or ribs which connect the pressure and suction sidewalls in a direct linear fashion. It has been noted that while the above design provides low thermal stress levels, it may pose limitations on thermal efficiency resulting from increased coolant flow due to their simple forward or aft flowing serpentine-shaped cooling channels and relatively large flow cross-sectional areas. In a typical two-wall turbine airfoil as described above, a significant portion of the radial coolant flow remains toward the center of the flow cross-section between the pressure and suction sidewalls, and is hence underutilized for convective cooling.

Thermal efficiency of a gas turbine engine may be increased by lowering the turbine coolant flow rate. However, as available coolant air is reduced, it may become significantly harder to cool the airfoil. For example, in addition to being able to carry less heat out of the airfoil, the lower coolant flows also make it much more difficult to generate high enough velocities and heat transfer rates to meet cooling requirements. To address this issue, techniques have been developed to implement near-wall cooling, such as that disclosed in the International Application No. PCT/US2015/047332, filed by the present applicant, and herein incorporated by reference in its entirety. Briefly, such a near-wall cooling technique employs the use of a flow displacement element to reduce the flow cross-sectional area of the coolant, thereby increasing convective heat transfer, while also increasing the target wall velocities as a result of the narrowing of the flow cross-section. Furthermore, this leads to an efficient use of the coolant as the coolant flow is displaced from the center of the flow cross-section toward the hot walls that need the most cooling, namely, the pressure and suction sidewalls. Embodiments of the present invention provide a further improvement on the aforementioned near-wall cooling technique.

Referring now to FIG. 1, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The airfoil 10 may include an outer wall 14 adapted for use, for example, in a high pressure stage of an axial flow gas turbine engine. The outer wall 14 extends span-wise along a radial direction R of the turbine engine and includes a generally concave shaped pressure sidewall 16 and a generally convex shaped suction sidewall 18. The pressure sidewall 16 and the suction sidewall 18 are joined at a leading edge 20 and at a trailing edge 22. The outer wall 14 may be coupled to a root 56 at a platform 58. The root 56 may couple the turbine airfoil 10 to a disc (not shown) of the turbine engine. The outer wall 14 is delimited in the radial direction by a radially outer end face or airfoil tip 52 and a radially inner end face 54 coupled to the platform 58. In other embodiments, the airfoil 10 may be a stationary turbine vane with a radially inner end face coupled to the inner diameter of the turbine section of the turbine engine and a radially outer end face coupled to the outer diameter of the turbine section of the turbine engine.

Figure 2:
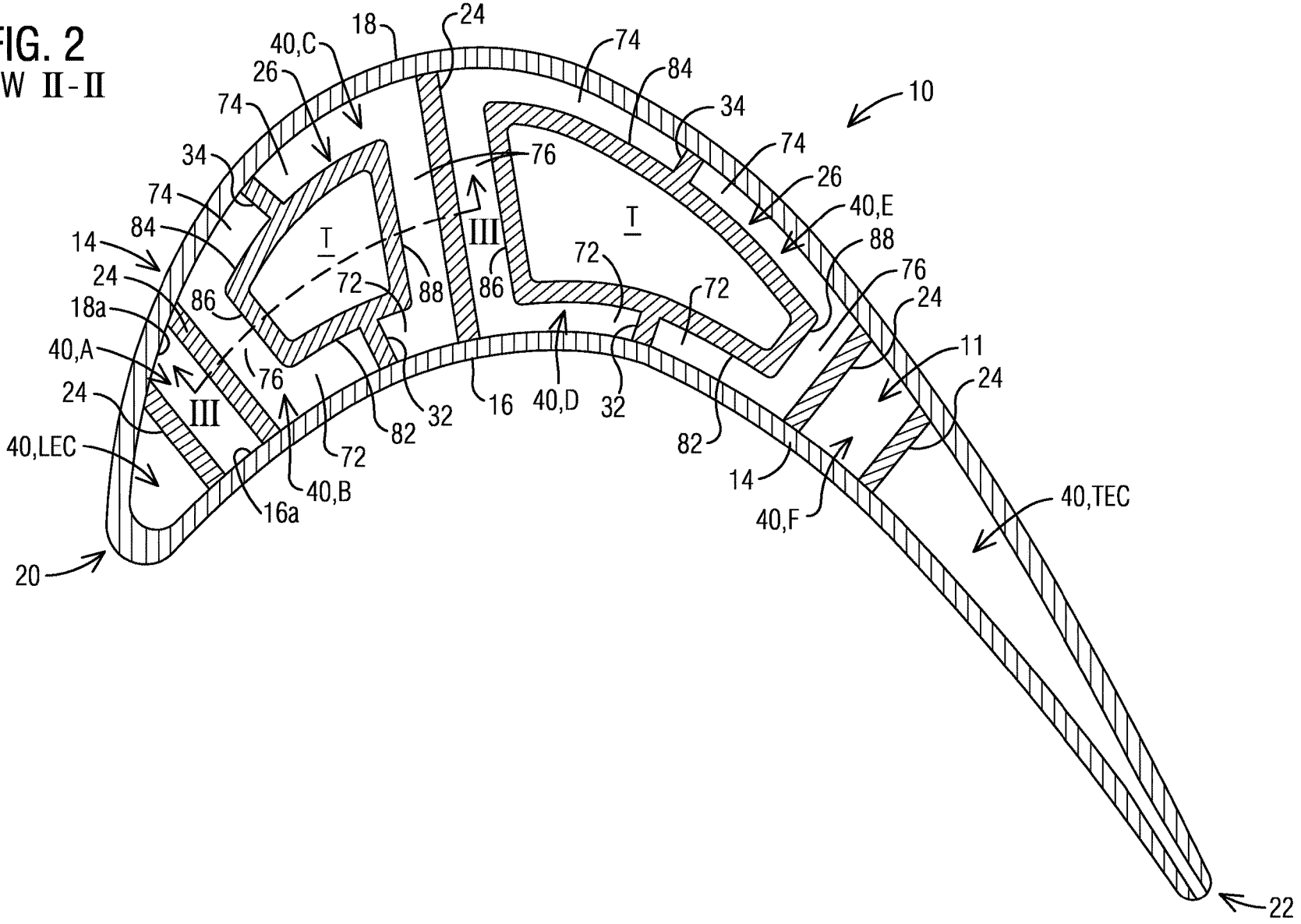
FIG. 2 is a radial cross-sectional view through the turbine airfoil along the section II-II of FIG. 1.

Referring to FIGS. 1 and 2, the outer wall 14 delimits an airfoil interior 11 comprising internal cooling channels, which may receive a coolant, such as air from a compressor section (not shown), via one or more coolant supply passages (not shown) through the root 56. A plurality of partition walls 24 are positioned spaced apart in the interior portion 11. The partition walls 24 extend along a radial extent, connecting the pressure sidewall 16 and the suction sidewall 18 to define internal radial cavities 40. At least some of the radial cavities 40 serve as internal cooling channels which are individually identified as A, B, C, D, E, F. Each of the internal cooling channels A-F is adjoined on opposite sides by the pressure sidewall 16 and the suction sidewall 18, such that an internal surface 16*a* of the pressure sidewall 16 and an internal surface 18*a* of the suction sidewall 18 define heat transfer surfaces in relation to the coolant flowing through the respective internal cooling channel A-F. The coolant traverses through the internal cooling channels A-F, absorbing heat from the airfoil components, particularly the hot outer wall 14. The internal cooling channels A-F lead the coolant to a leading edge coolant cavity LEC adjacent to the leading edge 20 and to a trailing edge coolant cavity TEC adjacent to the trailing edge 22. From the cavities LEC and TEC, the coolant exits the airfoil 10 via exhaust orifices 27 and 29 positioned along the leading edge 20 and the trailing edge 22 respectively. The exhaust orifices 27 provide film cooling along the leading edge 20 (see FIG. 1). Although not shown in the drawings, film cooling orifices may be provided at multiple locations, including anywhere on the pressure sidewall 16, suction sidewall 18, leading edge 20 and the airfoil tip 52. However, embodiments of the present invention provide enhanced convective heat transfer using low coolant flow, which make it possible to limit film cooling only to the leading edge 20, as shown in FIG. 1.

Referring to FIG. 2, a flow displacement element in the form of a flow blocking body 26 may be positioned in at least one of the radial cavities 40. In the present example, two such flow blocking bodies 26 are shown, each being elongated in the radial direction (perpendicular to the plane of FIG. 2). Each flow blocking body 26 occupies an inactive volume within the respective cavity 40. That is to say that there is no coolant flow through the volume occupied by the flow blocking body 26. Thereby a significant portion of the coolant flow in the cavity 40 is displaced toward the hot outer wall 14 for effecting near-wall cooling. In this case, each flow blocking body 26 has a hollow construction, having a cavity T therein through which no coolant flows. To this end, one or both radial ends of the cavity T may be capped or sealed off to prevent ingestion of coolant into the cavity T. In alternate embodiments, the flow blocking body 26 may have a solid construction. A hollow construction of the flow blocking bodies 26 may provide reduced thermal stresses as compared to a solid body construction, and furthermore may result in reduced centrifugal loads in case of rotating blades. As shown, connector ribs 32, 34 are provided that respectively connect the flow blocking body 26 to the pressure and suction sidewalls 16 and 18 along a radial extent. In a preferred embodiment, the flow blocking body 26 and the connector ribs 32, 34 may be manufactured integrally with the airfoil 10 using any manufacturing technique that does not require post manufacturing assembly as in the case of inserts. In one example, the flow blocking body 26 may be cast integrally with the airfoil 10, for example from a ceramic casting core. Other manufacturing techniques may include, for example, additive manufacturing processes such as 3-D printing. This allows the inventive aspects to be used for highly contoured airfoils, including 3-D contoured blades and vanes. However, other manufacturing techniques are within the scope of the present invention, including, for example, assembly (via welding, brazing, etc.) or plastic forming, among others.

The illustrated cross-sectional shape of the flow blocking bodies 26 is exemplary. The precise shape of the flow blocking body 26 may depend, among other factors, on the shape of the radial cavity 40 in which it is positioned. In the illustrated embodiment, each flow blocking body 26 comprises first and second opposite side faces 82 and 84. The first side face 82 is spaced from the pressure sidewall 16 such that a first radially extending near-wall cooling channel 72 is defined between the first side face 82 and the pressure sidewall 16. The second side face 84 is spaced from the suction sidewall 18 such that a second radially extending near-wall cooling channel 74 is defined between the second side face 84 and the suction sidewall 18. Each flow blocking body 26 further comprises third and fourth opposite side faces 86 and 88 extending between the first and second side faces 82 and 84. The third and fourth side faces 86 and 88 are respectively spaced from the partition walls 24 on either side to define a respective connecting channel 76 between the respective side face 86, 88 and the respective partition wall 24. Each connecting channel 76 extends transversely between the first and second near-wall cooling channels 72, 74 and is connected to the first and second near-wall cooling channels 72 and 74 along a radial extent to define a flow cross-section for radial coolant flow. The provision of the connecting channel 76 results in reduced thermal stresses in the airfoil 10 and may be preferable over structurally sealing the gap between the flow blocking body 26 and the respective partition wall 24.

As illustrated in FIG. 2, due to the inactive volume occupied by the flow blocking bodies 26 in the respective cavities 40, the resultant flow cross-section in each of the internal cooling channels B, C, D and E is generally C-shaped, being formed by the first and second near-wall cooling channels 72, 74 and a respective connecting channel 76. Further, as shown, a pair of adjacent internal cooling channels of symmetrically opposed C-shaped flow cross-sections are formed on opposite sides of each flow blocking body 26. For example, the pair of adjacent internal cooling channels B, C have symmetrically opposed C-shaped flow cross-sections. A similar explanation may apply to the pair of adjacent internal cooling channels D, E. It should be noted that the term "symmetrically opposed" in this context is not meant to be limited to an exact dimensional symmetry of the flow cross-sections, which often cannot be achieved especially in highly contoured airfoils. Instead, the term "symmetrically opposed", as used herein, refers to symmetrically opposed relative geometries of the elements that form the flow cross-sections of the internal cooling channels (i.e., the near-wall cooling channels 72, 74 and the connecting channel 76 in this example). Furthermore, the illustrated C-shaped flow cross-section is exemplary. Alternate embodiments may employ, for example, an H-shaped flow cross-section defined by the near-wall cooling channels 72, 74 and the connecting channel 76. The internal cooling channels of each pair B, C and D, E may conduct coolant in opposite radial directions, being fluidically connected in series to form a serpentine cooling path, as disclosed in the International Application No. PCT/US2015/047332 filed by the present applicant.

The present inventors have devised a mechanism to divert or push more of the radially flowing coolant in the internal cooling channels A-F toward the hot outer wall 14 away from the central portion of the internal cooling channels A-F. As per the embodiments of the present invention shown in FIGS. 3-6 and 8, the above effect is achieved by providing a flow splitter feature 90 located in a flow path of the coolant in one or more of the internal cooling channel A-F between the pressure and suction sidewalls 16, 18. The flow splitter feature 90 is effective to create a flow separation region downstream of the flow splitter feature 90 that leads to a modification of the coolant flow distribution downstream of the flow splitter feature 90, whereby coolant flow is locally increased along the internal surfaces 16*a*, 18*a* of the pressure and suction sidewalls 16, 18 respectively in relation to the central portion of the flow cross-section between the pressure and suction sidewalls 16, 18. Heat transfer between the coolant and the outer wall 14 is thereby increased. Since a larger fraction of the coolant is now utilized for heat transfer with the hot outer wall 14 (because there is a higher mass flow rate per unit area in the region adjacent to the pressure and suction sidewalls 16, 18), the coolant requirement may be reduced significantly, thereby increasing engine thermal efficiency.

Figure 3:
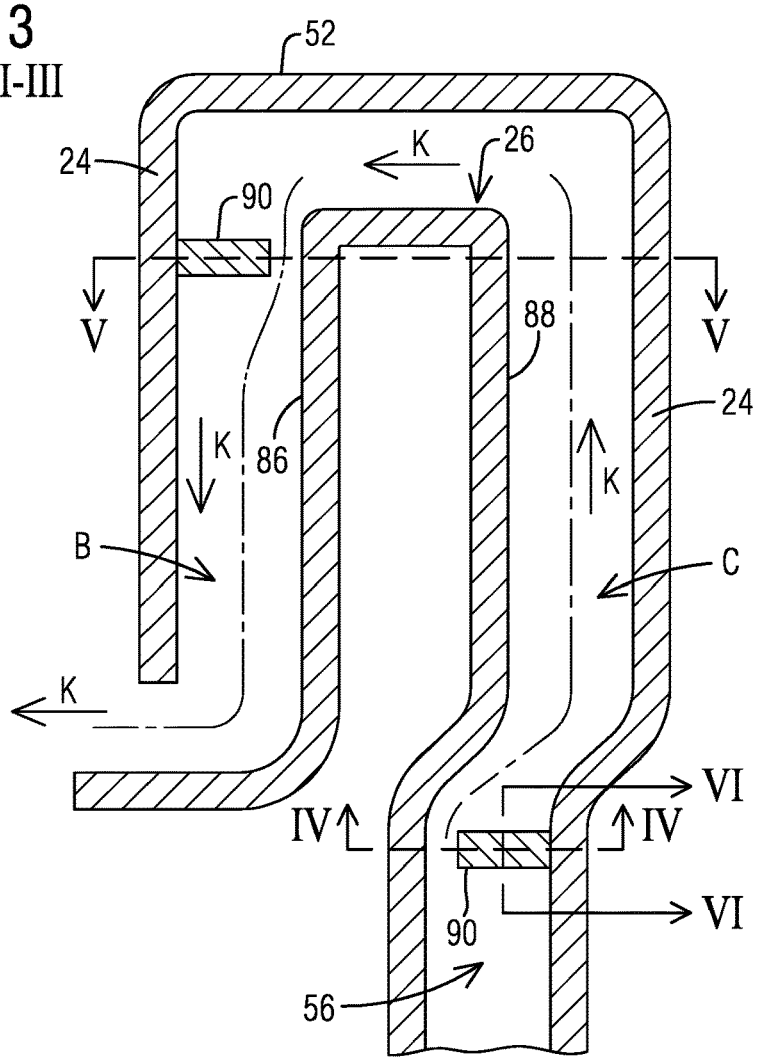
FIG. 3 is a span-wise cross-sectional view along the section III-III in FIG. 2.

In one embodiment, as shown in FIG. 3, an inventive flow splitter feature 90 may be positioned at an inlet of an internal cooling channel. According to this embodiment, a first flow splitter feature 90 may be positioned at an inlet of the internal cooling channel C, which may be located, for example, at the root 56 of the airfoil 10. A second flow splitter feature 90 may be positioned at an inlet of the internal cooling channel B, which may be located close to the airfoil tip 52. The internal cooling channel C may be configured as an "up" pass, conducting coolant K from root 56 to tip 52, while the internal cooling channel B may be configured as a "down" pass, conducting coolant K from the tip 52 to the root 56. The "up" and "down" passes may be fluidically connected near the airfoil tip 52 to form a serpentine cooling path. As shown, the flow splitter features 90 of the adjacent internal cooling channels B and C may be located at radially opposite ends of the respective internal cooling channels B and C.

Figure 4:
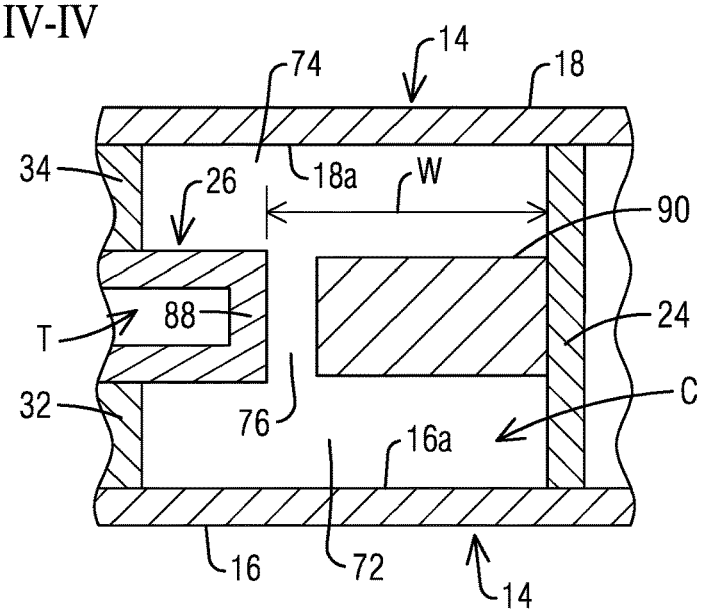
FIG. 4, FIG. 5 and FIG. 6 are schematic cross-sectional views along the sections IV-IV, V-V and VI-VI respectively in FIG. 3.
Figure 5:
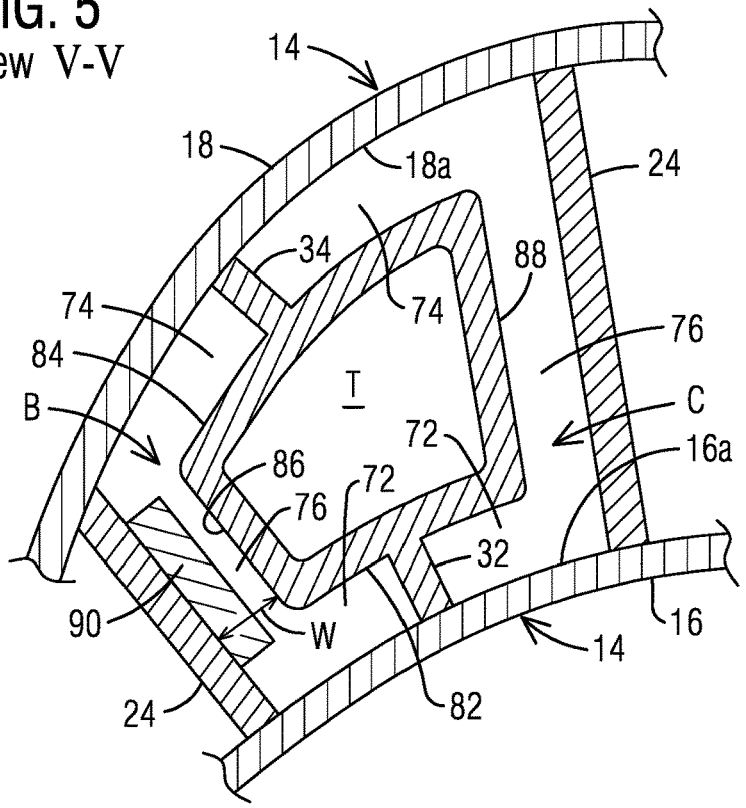

Each of the flow splitter features 90 may be configured as a bluff body. The bluff body 90 may extend perpendicular to the flow direction of the coolant K. As shown in FIGS. 4 and 5, each of the flow splitter features 90 may be positioned in the respective connecting channel 76, preferably centrally between the pressure sidewall 16 and the suction sidewall 18. The flow splitter features 90 may extend at least partially across a width W of the connecting channel 76 at the inlet of the respective internal cooling channel B, C, the width W being defined as a distance between the partition wall 24 and a respective side face 86, 88 of the flow blocking body 26. In the shown embodiment, each flow splitter feature 90 protrudes from the partition wall 24, extending partially across the width of the connecting channel 76. In alternate embodiments, one or more of the flow splitter features 90 may protrude from a respective side face 86, 88 of the flow blocking body 26, extending partially across the width of the connecting channel 76. In yet another embodiment, flow splitter features 90 may protrude from both, the partition wall 24 as well as the respective side face 86, 88 of the flow blocking body 26, into the connecting channel 76. In this case, it may be preferable to maintain a gap between the flow splitter feature 90 extending from the partition wall 24 and that extending from the respective side face 86, 88 of the flow blocking body 26, which would prevent a structural connection between the flow blocking body 26 and the partition wall 24 across the connecting channel 76, thus avoiding high thermal stresses in the airfoil 10. In alternate embodiments, the flow splitter feature 90 may extend entirely across the width of the connecting channel 76, connecting the partition wall 24 and the respective side face 86, 88 of the flow blocking body 26. In one embodiment, the flow splitter features 90 may be manufactured integrally with the airfoil 10 by any of the manufacturing processes mentioned above.

Figure 6:
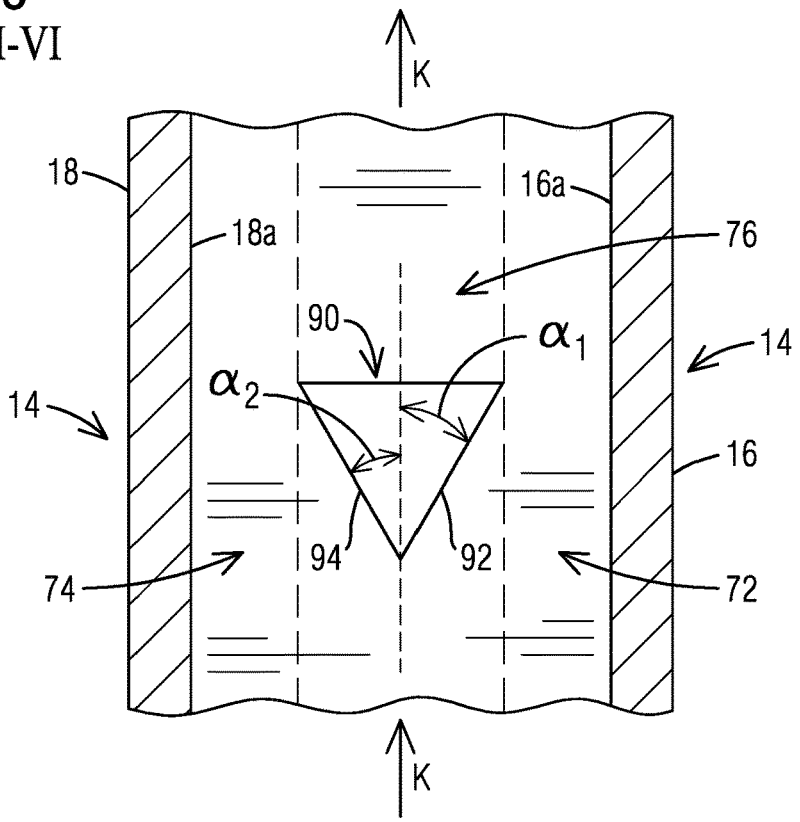

The cross-section of the bluff body 90 may be shaped to create a flow disturbance which forces the coolant to flow around the bluff body 90, forming a flow separation region downstream of the bluff body 90 in the connecting channel 76. The separation of flow leads to a modification of coolant flow distribution across the flow cross-section of the inter cooling channel downstream of the flow splitter feature 90, whereby coolant flow is pushed toward the near-wall cooling channels 72, 74. This has the effect of locally reducing the coolant flow velocity in the connecting channel 76, while locally increasing the coolant flow velocity in the near-wall cooling channels 72, 74. An increase in coolant velocity locally along the pressure and suction sidewalls 16, 18 directly results in an increase in convective heat transfer coefficient between the coolant and the outer wall 14. Overall heat transfer between the coolant and the outer wall 14 is thereby enhanced. Since a larger fraction of the coolant is now utilized for heat transfer with the hot outer wall 14 (because there is a higher mass flow rate per unit area in the near wall cooling channels 72, 74), the coolant requirement may be reduced significantly, thereby increasing engine thermal efficiency. In one embodiment, as shown in FIG. 6, the cross-section of the bluff body 90 may have a triangular shape, comprising a first side 92 facing the pressure sidewall 16 and a second side 94 facing the suction sidewall 18. Each of the first and second sides 92, 94 is inclined at an angle $\alpha_1$, $\alpha_2$ with respect to the direction of flow of the coolant K, such that the first and second sides 92, 94 diverge in the direction of flow of the coolant K. The angle $\alpha_1$, $\alpha_2$ of inclination of the sides 92, 94 is directly related to the angle of attack of the coolant K on the bluff body 90, and is preferably chosen to be large enough to ensure a dominance of form drag forces over frictional drag forces on the bluff body 90. A larger angle of attack would create greater flow disturbances around the bluff body 90 due to the dominance of form drag forces, thereby causing a separation of flow downstream of the bluff body 90. In an example embodiment, the angles $\alpha_1$, $\alpha_2$ may each have a value up to 45 degrees. Preferably, the bluff body 90 is aerodynamically configured such that the flow separation region spans substantially over the entire length of the internal cooling channel 76 along the flow direction of the coolant K.

Figure 7:
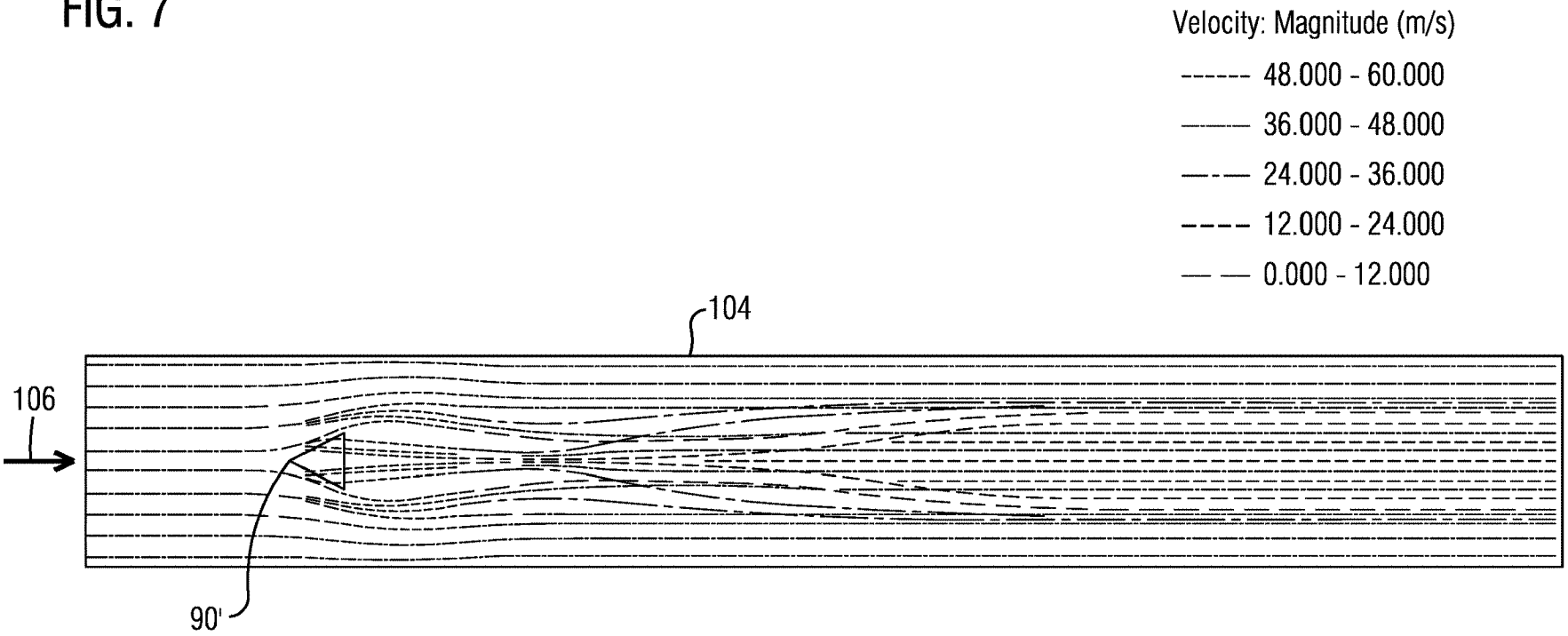
FIG. 7 illustrates streamlines around a triangular flow splitter feature in a coolant channel.

FIG. 7 illustrates streamlines around a triangular flow splitter feature 90', of the type described above. The streamlines were generated in a test case using a closed flow conduit defined by a conduit wall 104. The direction of flow is indicated by the arrow 106. The streamlines clearly indicate a local acceleration of flow near the splitter feature 90' resulting in high target wall heat transfer. The impact of the flow disturbance, i.e., flow being pushed toward the conduit wall 104 from the center of the conduit can be seen well beyond the flow splitter feature 90' itself. Based on the velocity modification that is seen, it may be feasible to use such a flow splitter feature even in a standard two-wall internal cooling channel, for example the internal cooling channels A and F shown in FIG. 2. In a further embodiment, a series of such flow splitter features may be arranged along the flow direction to emulate a near-wall cooling scheme in said two-wall internal cooling channel. Due to the flow splitter features and the separation produced by them, the coolant flow is continuously forced near the outer wall 14 at higher velocities. This makes it possible to significantly reduce the coolant mass flow rate the internal cooling channel, which may be difficult to achieve in an unmodified internal cooling channel.

It is to be noted that the above-described geometry of the flow splitter feature is exemplary and other bluff body shapes may be employed. For example, instead of a triangular shape, the flow splitter feature may incorporate alternate cross-sectional shapes, including trapezoidal, semi-elliptical, semi-circular, or other bluff body shapes. Furthermore, in the illustrated embodiment, the flow splitter feature is only used at the inlet of the internal cooling channel. In alternate embodiments, multiple flow splitter features may be placed spaced apart along the flow direction of the coolant in the internal cooling channel. With such an arrangement, it may be possible to create a superposition effect to actively prevent coolant flow from returning to the relatively colder central portion of the internal cooling channel.

Figure 8:
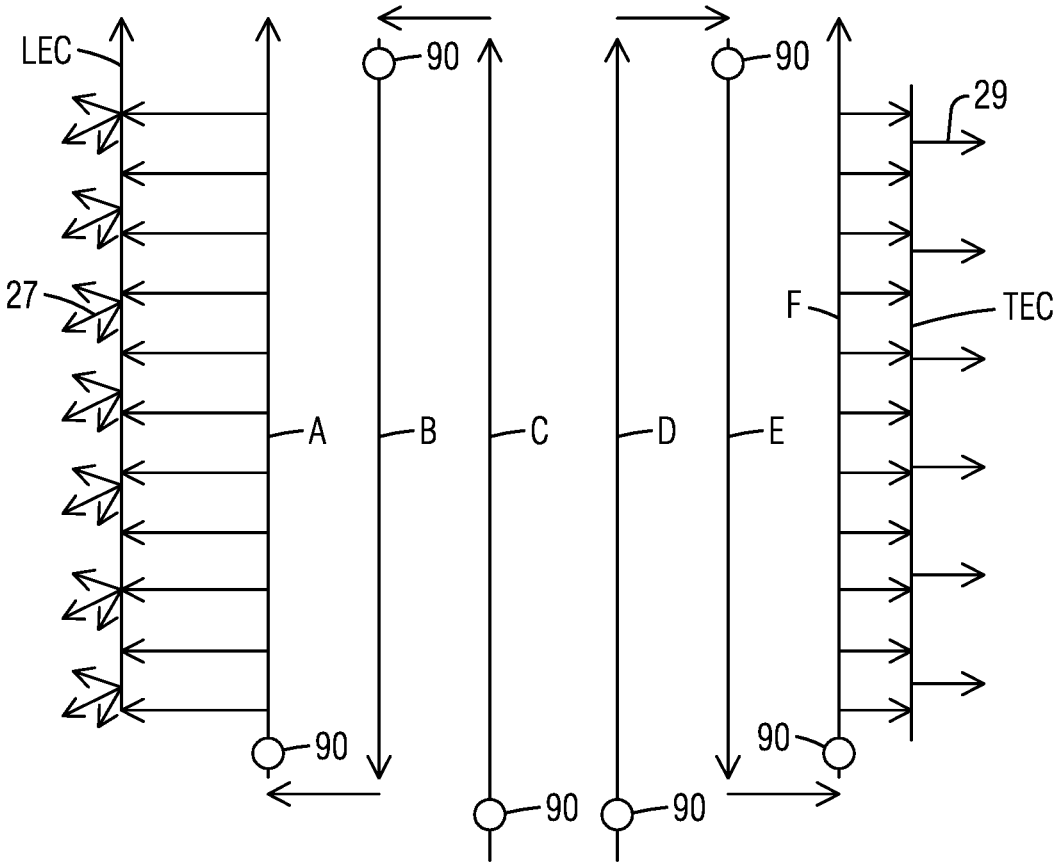
FIG. 8 is a flow diagram illustrating an exemplary serpentine flow scheme through the airfoil, incorporating flow splitter features according to one embodiment of the invention.

Referring now to FIG. 8 in conjunction with FIG. 2, an example cooling scheme is illustrated incorporating aspects of the present invention. The illustrated cooling scheme involves two oppositely directed serpentine cooling paths 60*a* and 60*b*. The serpentine cooling paths 60*a* and 60*b* respectively begin at the internal cooling channels C and D, which may be independently supplied with coolant via the airfoil root 56. In the illustrated embodiment, the serpentine cooling path 60*a* extends in an aft-to-forward direction, wherein the internal cooling channels C and A are configured as "up" passes, while the internal cooling channel B is configured as a "down" pass. The serpentine cooling path 60*b* extends in a forward-to-aft direction, wherein the internal cooling channels D and F are configured as "up" passes, while the internal cooling channel E is configured as a "down" pass. From the internal cooling channel A, the coolant may enter the leading edge coolant cavity LEC, for example, via impingement openings, and then be discharged into the hot gas path via exhaust orifices 27 on the outer wall which may collectively form a shower head for cooling the leading edge 20 of the airfoil 10. The internal cooling channel F may be in fluid communication with the trailing edge coolant cavity TEC, which may incorporate trailing edge cooling features as known to one skilled in the art, for example, comprising turbulators, or pin fins, or combinations thereof, before being discharged into the hot gas path via exhaust orifices 29 located along the trailing edge 22. As schematically shown, a flow splitter feature 90 may be placed at the inlet of each of the "up" and "down" passes of the serpentine paths 60*a*, 60*b* in order to enhance the flow field of each of the internal cooling channels. In this embodiment, an "inlet" refers to an entrance or a beginning of an "up" or a "down" pass. As shown, the flow splitter features 90 may not only be located at the entrances of the C-shaped internal cooling channels B, C, D, and E, but also at the entrances of the traditional two-wall internal cooling channels A and F.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

an outer wall delimiting an airfoil interior, the outer wall extending span-wise along a radial direction of a turbine engine and being formed of a pressure sidewall and a suction sidewall joined at a leading edge and a trailing edge, at least one internal cooling channel in the airfoil interior, the internal cooling channel extending in the radial direction and being adjoined on opposite sides by the pressure sidewall and the suction sidewall such that an internal surface of the pressure sidewall and an internal surface of the suction sidewall define heat transfer surfaces in relation to a coolant flowing through the internal cooling channel, and a flow splitter feature located in a flow path of the coolant in the internal cooling channel between the pressure and suction sidewalls, the flow splitter feature being effective to create a flow separation region downstream of the flow splitter feature, whereby coolant flow velocity is locally increased along the internal surfaces of the pressure and suction sidewalls, to enhance heat transfer between the coolant and the outer wall, wherein the flow splitter feature is located at an entrance of the internal cooling channel.

2. The turbine airfoil according to claim 1, wherein the flow splitter feature comprises a bluff body.

3. The turbine airfoil according to claim 2, wherein the bluff body extends at least partially across the internal cooling channel perpendicular to a direction of flow of the coolant in the internal cooling channel, and wherein a cross-section of the bluff body is shaped to create said flow separation region downstream of the bluff body.

4. The turbine airfoil according to claim 3, wherein the bluff body includes first and second sides that diverge in the direction of flow of the coolant and which respectively face the pressure and suction sidewalls.

5. The turbine airfoil according to claim 4, wherein the cross-section of the bluff body has a triangular shape.

6. The turbine airfoil according to claim 1, wherein the flow splitter feature is located centrally between the pressure sidewall and the suction sidewall.

7. The turbine airfoil according to claim 1, comprising a plurality of flow splitter features located in the internal cooling channel, the plurality of flow splitter features being spaced apart in a direction of flow of the coolant in the internal cooling channel.

8. The turbine airfoil according to claim 1, comprising a plurality of radially extending internal cooling channels, wherein adjacent internal cooling channels are separated by a respective partition wall connecting the pressure and suction sidewalls along a radial extent, and wherein one or more of the internal cooling channels are provided with a flow splitter feature.

9. The turbine airfoil according to claim 8, wherein the flow splitter feature protrudes into the internal cooling channel from one of the partition walls.

10. The turbine airfoil according to claim 8, wherein adjacent internal cooling channels conduct coolant in opposite radial directions to form a serpentine cooling path.

11. The turbine airfoil according to claim 1, wherein the internal cooling channel is formed by a first near-wall cooling channel located adjacent to the pressure sidewall, a second near-wall cooling channel located adjacent to the suction sidewall and a connecting channel extending transversely between the first and second near-wall cooling channels, and wherein the flow splitter feature is located at the entrance of the internal cooling channel in the connecting channel.

12. A turbine airfoil comprising:

an outer wall delimiting an airfoil interior, the outer wall extending span-wise along a radial direction of a turbine engine and being formed of a pressure sidewall and a suction sidewall joined at a leading edge and a trailing edge, at least one partition wall positioned in the airfoil interior connecting the pressure and suction sidewalls along a radial extent so as define a plurality of radial cavities in the airfoil interior, an elongated flow blocking body positioned in at least one of the radial cavities so as to occupy an inactive volume therein, the flow blocking body extending in the radial direction and being spaced from the pressure sidewall, the suction sidewall and the partition wall, whereby a first near-wall cooling channel is defined between the flow blocking body and the pressure sidewall, a second near-wall cooling channel is defined between the flow blocking body and the suction sidewall, and a connecting channel is defined between the flow blocking body and the partition wall, the connecting channel being connected to the first and second near-wall cooling channels along a radial extent to define a radially extending internal cooling channel, a flow splitter feature located at an entrance of the internal cooling channel and being shaped to create a flow separation region downstream of the flow splitter feature in the connecting channel, whereby coolant flow velocity is locally increased in the first and second near-wall cooling channels in relation to the connecting channel, to enhance heat transfer between the coolant and the outer wall.

13. The turbine airfoil according to claim 12, wherein the flow separation region is located in the connecting channel.

14. The turbine airfoil according to claim 12, wherein the flow splitter feature comprises a bluff body extending at least partially across a width of the connecting channel between the flow blocking body and the respective partition wall at the entrance of the internal cooling channel.

15. The turbine airfoil according to claim 14, wherein the flow splitter feature protrudes into the connecting channel from the partition wall and/or from a side face of the flow blocking body facing the connecting channel.

16. The turbine airfoil according to claim 12, further comprising pair of connector ribs that respectively connect the flow blocking body to the pressure and suction sidewalls along a radial extent, whereby a pair of adjacent internal cooling channels of symmetrically opposed flow cross-sections are defined on opposite sides of the flow blocking body, wherein each of the of adjacent internal cooling channels is provided with a flow splitter feature at the entrance thereof.

17. The turbine airfoil according to claim 16, wherein the pair of adjacent internal cooling channels conduct coolant in opposite radial directions and are fluidically connected in series to form a serpentine cooling path, and wherein the flow splitter features of the adjacent internal cooling channels are located at radially opposite ends of the adjacent internal cooling channels.

* * * * *